US008444336B2

(12) United States Patent
Kageyama et al.

(10) Patent No.: US 8,444,336 B2
(45) Date of Patent: May 21, 2013

(54) LEAD CARTRIDGE AND MECHANICAL PENCIL WITH BUILT-IN LEAD CARTRIDGE

(75) Inventors: Hidehei Kageyama, Kawagoe (JP); Yoshio Noguchi, Kawagoe (JP)

(73) Assignee: Kotobuki & Co., Ltd., Kawagoe-Shi, Saitama (JP)

( * ) Notice: Subject to any disclaimer, the term of this patent is extended or adjusted under 35 U.S.C. 154(b) by 438 days.

(21) Appl. No.: 12/733,834

(22) PCT Filed: Sep. 22, 2008

(86) PCT No.: PCT/JP2008/067088

§ 371 (c)(1),
(2), (4) Date: Mar. 23, 2010

(87) PCT Pub. No.: WO2009/041386

PCT Pub. Date: Apr. 2, 2009

(65) Prior Publication Data

US 2010/0209173 A1 Aug. 19, 2010

(30) Foreign Application Priority Data

Sep. 25, 2007 (JP) ..... 2007-247894
Nov. 15, 2007 (JP) ..... 2007-296599

(51) Int. Cl.
*B43K 21/00* (2006.01)
*B43K 23/00* (2006.01)

(52) U.S. Cl.
USPC ..... 401/85; 401/89

(58) Field of Classification Search
USPC ..... 401/85, 89, 107, 108, 109, 110, 111
See application file for complete search history.

(56) References Cited

U.S. PATENT DOCUMENTS 4,836,703 A * 6/1989 Kageyama et al. ..... 401/65
4,984,288 A * 1/1991 Petterson ..... 401/86

(Continued)

FOREIGN PATENT DOCUMENTS

JP 62-173981 11/1987
JP 6-2438 1/1994

(Continued)

OTHER PUBLICATIONS

Japanese Office Action dated Mar. 22, 2011.

(Continued)

*Primary Examiner* — David Walczak
*Assistant Examiner* — Jennifer C Chiang
(74) *Attorney, Agent, or Firm* — McGinn IP Law Group, PLLC

(57) ABSTRACT

A lead cartridge adapted for storing leads and capable of being detachably connected to a lead feeding mechanism of a mechanical pencil to supply the leads one by one to the lead feeding mechanism, the mechanical pencil being provided with an interference part, the lead feeding mechanism being provided with a receiving part. The lead cartridge includes a tank part for storing the leads, a tip end connection part capable of being detachably fitted with the receiving part of the lead feeding mechanism, a lead port provided on a tip end side of the tank part to allow one of the leads in the tank part to pass from the tank part, and a swing cover arranged in the lead cartridge to be swingable between a closing position where the swing cover closes the lead port, and an opening position where the swing cover opens the lead port.

19 Claims, 10 Drawing Sheets

U.S. PATENT DOCUMENTS

| | | | | | |
|---|---|---|---|---|---|
| 4,998,837 | A | * | 3/1991 | Kageyama et al. | 401/85 |
| 5,388,722 | A | * | 2/1995 | Kageyama | 221/186 |
| 5,480,249 | A | * | 1/1996 | Kageyama et al. | 401/60 |
| 5,788,118 | A | | 8/1998 | Kageyama et al. | |
| 5,988,913 | A | * | 11/1999 | Kageyama et al. | 401/52 |

FOREIGN PATENT DOCUMENTS

| | | | |
|---|---|---|---|
| JP | 11-78355 | | 3/1999 |
| JP | 11-78355 | A | 3/1999 |
| JP | 2002-67575 | | 3/2002 |
| JP | 2002-67575 | A | 3/2002 |
| JP | 2002-316497 | | 10/2002 |

OTHER PUBLICATIONS

European Search Report dated Jun. 25, 2012.

* cited by examiner

LEAD CARTRIDGE AND MECHANICAL PENCIL WITH BUILT-IN LEAD CARTRIDGE

TECHNICAL FIELD

The invention relates to a lead cartridge for refilling a mechanical pencil with leads or for changing leads of a mechanical pencil, and to a mechanical pencil with built-in the lead cartridge.

BACKGROUND ART

As a lead cartridge of this type, a lead cartridge disclosed in Patent Document 1 (Japanese Patent Application examined Publication No. 6-2438) is conventionally known. According to the document, the lead cartridge includes a tip end opening to be detachably inserted into a lead guide, which is provided in a lead feeding mechanism of the mechanical pencil. In the tip end opening, a chuck opening/closing is mounted. The chuck opening/closing mechanism is provided with a lead port, which is opened when the tip end opening is inserted to and engaged with the lead guide and closed when the tip end opening is not engaged.

The chuck opening/closing mechanism includes a pair of elastic opening/closing sections and outwardly engagement sections, which are formed integrally with the elastic opening/closing sections on the tip end side thereof to protrude outwardly in a diameter direction to opposite side to each other and each of which has a tip formed in a round shape. The elastic opening/closing sections form the lead port at the axis center on the tip end side and are elastically deformed to opposite directions to close the lead port by an inward elastic force. When the outwardly engagement sections are press-inserted to and engaged with the lead guide, the outwardly engagement sections move inwardly in a diameter direction against the inward elastic force to open the lead port. When the outwardly engagement sections are pulled out from the lead guide so as to be released from the press-inserted engagement, the outwardly engagement sections move outwardly in the diameter direction by an elastic restoring force to close the lead port.

SUMMARY OF INVENTION

Technical Problem

However, since the configuration disclosed in Patent Document 1 includes the opening/closing mechanism of chuck type, it requires at least two parts. Accordingly, more costs for manufacturing and troublesome mounting work of the parts of the opening/closing mechanism are unfortunately required. Therefore, further improvement has been demanded.

In addition, since the outwardly engagement sections formed in a round shape protrude outwardly, the lead port is accidentally opened if the outwardly engagement sections are pushed inwardly under a condition that the lead port should be closed, resulting in inadvertent falling out of the lead from the lead cartridge.

Further, since the pair of elastic opening/closing sections is mounted at the tip end opening, the problem is that the lead cartridge has to be longer corresponding to the pair of elastic opening/closing sections.

The invention has been accomplished in view of the above defects and the object thereof is to provide a lead cartridge capable of reducing costs for manufacturing and the number of manufacturing steps and capable of preventing leads from falling out from the lead cartridge inadvertently.

In addition, another object of the invention is to provide a lead cartridge allowing the lead cartridge to be connected to a mechanical pencil even with a lead held by a lead feeding mechanism in the mechanical pencil.

Solution to Problem

To accomplish the above objects, a lead cartridge according to an aspect of the invention, which is provided with a tank part for storing leads and is capable of being detachably connected to a receiving part provided in a lead feeding mechanism of a mechanical pencil to supply a lead, includes:

a tip end connection part that can be detachably fitted with the receiving part;

a lead port provided on a tip end side of the tank part to allow a lead to pass therethrough from the tank part;

and a swing cover that is arranged in the lead cartridge swingably between a closing position where the swing cover closes the lead port and an opening position where the swing cover opens the lead port and that includes an interfered part capable of being interfered with an interference part provided in the mechanical pencil, wherein the swing cover is biased in a swing direction from the opening position to the closing position but swings from the closing position to the opening position when the tip end connection part is fitted with the receiving part so as to cause the interfered part to be interfered with the interference part.

Since the lead port can be closed/opened by the swing cover according to the aspect of the invention, the number of the parts is reduced, and thus the number of steps for mounting the swing cover is reduced. Therefore, costs for manufacturing and the number of manufacturing steps can be reduced.

In addition, the swing cover closes the lead port in the lead cartridge and it is difficult to easily operate the swing cover from the outside. Therefore, the swing cover may not be inadvertently operated and leads can be prevented from falling out from the tank part.

Since the swing cover swings in the lead cartridge, the whole length of the lead cartridge can be shortened.

The lead cartridge may further include a case, wherein the tank part is formed inside the case, the tip end connection part is formed at a tip end part of the case, the lead port is formed between the tank part and the tip end connection part in the case, and the swing cover can be mounted in a side opening formed in a side part of the case. Since only the swing cover is needed to be mounted in the case, the number of parts is reduced, and thus the number of steps for mounting the swing cover is reduced. Therefore, costs for manufacturing and the number of manufacturing steps can be reduced.

The interfered part may be formed with a tapering surface formed at a tip end of the swing cover. With the tapering surface of the interfered part, the swing cover can smoothly swing.

At least a part of the swing cover may be arranged in the tank part. Because at least a part of the swing cover is arranged in the tank part, a space for the swing cover can be efficiently secured in the tank part, and thus the length of the lead cartridge can be shortened.

A protrusion that closes the lead port may be formed on the swing cover and a protruding end of the protrusion may be in a tapering shape. Since the protruding end of the protrusion is in a tapering shape, even when at least a part of the swing cover is arranged in the tank part, its volume occupying in the tank part can be small. Therefore, a lead storage volume of the tank part can be secured.

The lead cartridge may further include a stick article advancing mechanism that advances a stick article through a rotating operation at a rear part of the lead cartridge. A stick article such as an eraser can have a sufficient length in an axial direction, and thus stick articles can be changed at the same time as replacement or replenishment of leads.

The swing cover may be swingable by a lead held by the lead feeding mechanism in the mechanical pencil. Even when a lead held by the lead feeding mechanism remains in the mechanical pencil, the lead can cause the swing cover to swing and can enter the lead cartridge through the lead port.

In a mechanical pencil into which the lead cartridge according to the aspect of the invention is to be loaded, the interference part may be formed with a tapering surface capable of interfering with the tip end of the swing cover. With the tapering surface of the interference part, the swing cover can smoothly swing.

Further, a lead cartridge according to another aspect of the invention, which is provided with a tank part for storing leads and is capable of being detachably connected to a receiving part provided in a lead feeding mechanism of a mechanical pencil to supply a lead, includes:

a tip end connection part that can be detachably fitted with the receiving part;

a lead port provided on a tip end side of the tank part to allow a lead to pass therethrough from the tank part;

and a swing cover that is arranged swingably to a closing position where the swing cover closes the lead port and to an opening position where the swing cover opens the lead port at a position posterior to the lead port, wherein the swing cover is biased in a swing direction from the opening position to the closing position, and prevents a lead in the tank part from aligning with the lead port in a condition closing the lead port.

Since the swing cover prevents a lead in the tank part from aligning with the lead port in a condition closing the lead port, even if a lead held by the lead feeding mechanism remains in the mechanical pencil when the lead cartridge is inserted into the mechanical pencil, the swing cover prevents this lead from aligning with a lead in the tank part while this lead is passing through the lead port and making the swing cover swing. Therefore, the leads can be prevented from interfering with each other so as to be broken.

BRIEF DESCRIPTION OF THE DRAWINGS

FIG. 2(*b*) is a longitudinal sectional view of the case of the lead cartridge of FIG. 1.

FIG. 2(*c*) is a sectional view taken along line 2*c*-2*c* of FIG. 2(*b*).

FIG. 2(*d*) is a sectional view taken along line 2*d*-2*d* of FIG. 2(*b*).

FIG. 2(*e*) is a sectional view taken along line 2*e*-2*e* of FIG. 2(*b*).

FIG. 3(*b*) is a perspective view of the swing cover of the lead cartridge of FIG. 1.

REFERENCE SIGNS LIST

10 lead cartridge
12, 12' case
12*a* tank part
12*b* tip end connection part
12*e* lead port
12*g* side opening
14 swing cover
14*c* interfered part
14*e* protrusion
16, 16' eraser advancing mechanism (stick article advancing mechanism)
30 mechanical pencil
34 lead feeding mechanism
46*b* cartridge receiving part
46*e* interference part

DESCRIPTION OF EMBODIMENTS

An embodiment of the invention will be described hereinafter with reference to the drawings.

Figure 1:
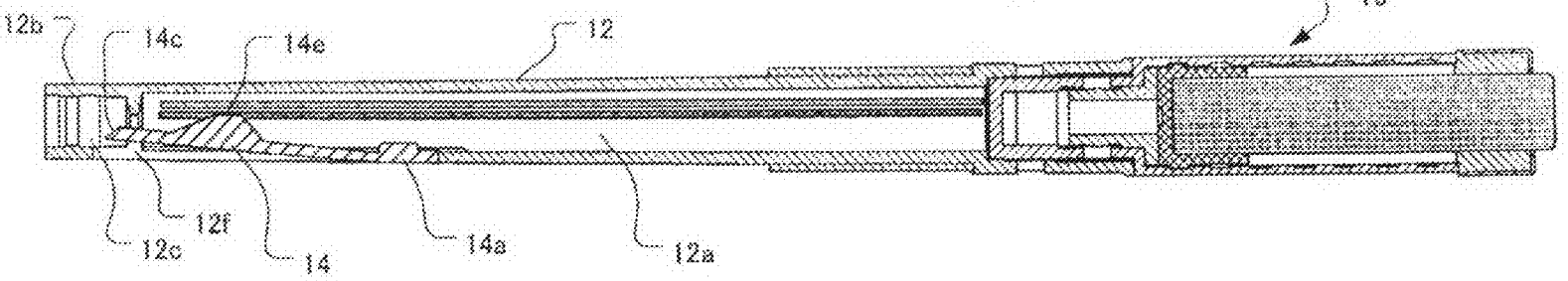
FIG. 1 is a whole longitudinal sectional view showing a lead cartridge according to the invention.

FIG. 1 is a whole longitudinal sectional view showing a lead cartridge according to the invention.

As shown in FIG. 1, a lead cartridge 10 includes a case 12, a swing cover 14, and an eraser advancing mechanism 16.

Figure 2:
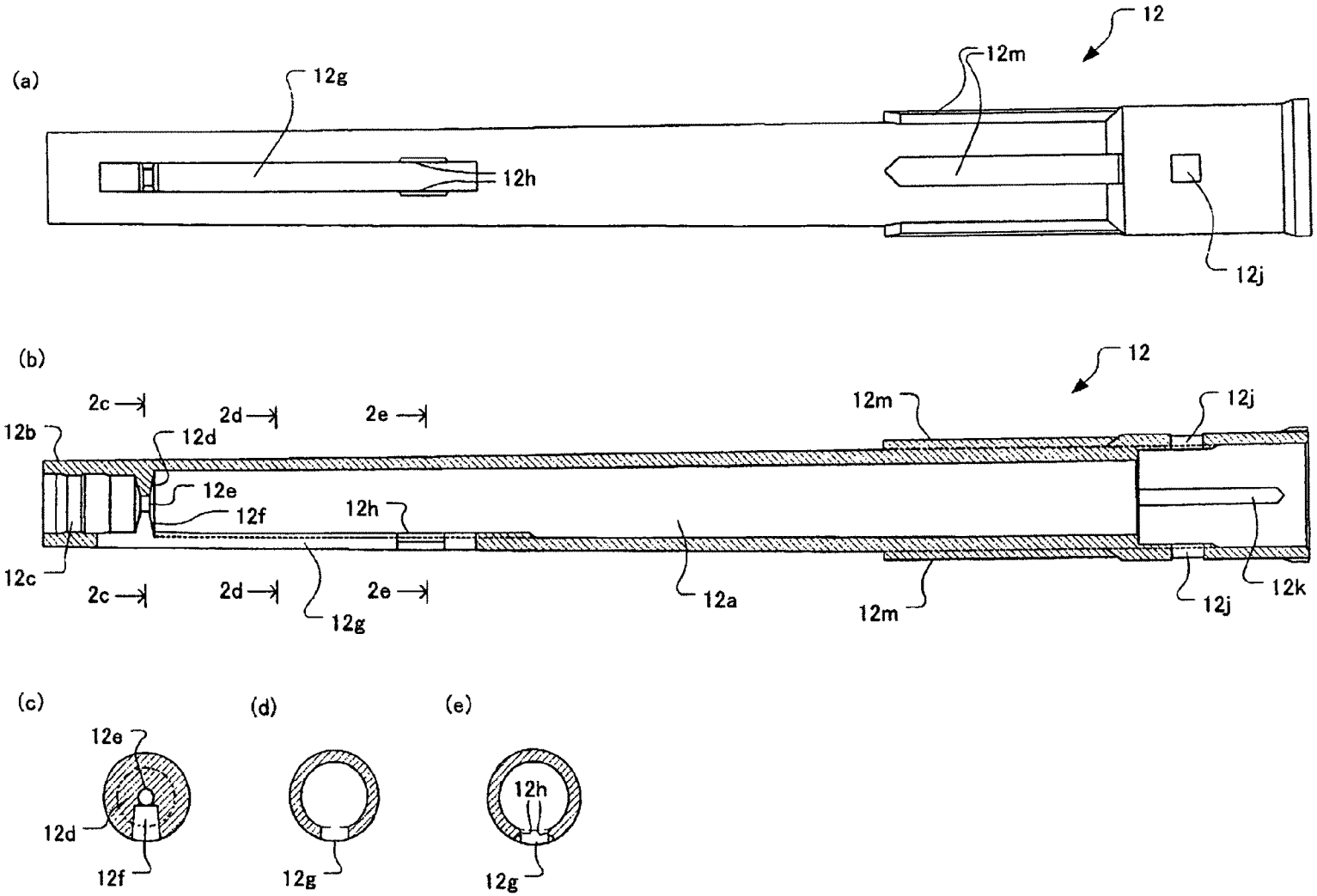
FIG. 2(*a*) is a plan view of a case of the lead cartridge of FIG. 1.

The case 12 may be configured as an integrated plastic molding and has an entirely cylindrical form as shown in enlarged scale in FIG. 2. A tank part 12*a* that stores leads is defined inside the case 12. The tip end part of the case 12 is formed with an open tip end connection part 12*b*. The tip end connection part 12*b* can be detachably fitted to a receiving part provided at a lead feeding mechanism of a mechanical pencil to be described below. To this end, a fitting rib 12*c* for engaging with the receiving part is formed on the inner surface of the tip end connection part 12*b*.

A partition wall 12*d* is formed between the tank part 12*a* and the tip end connection part 12*b* inside the case 12, and a lead port 12*e* having a form corresponding to a shape of a lead is formed at the center of the partition wall 12*d* so as to allow leads to pass therethrough one by one. The partition wall 12*d* is funnel-shaped toward the lead port 12*e*. In addition, the partition wall 12*d* is formed with a notch 12*f* extending in a diameter direction to reach the lead port 12*e*.

In a side surface of the case 12, a side opening 12*g* extending in an axial direction across the tank part 12*a*, the tip end connection part 12*b*, and the partition wall 12*d* is formed. The side opening 12*g* communicates with the notch 12*f*. A part having an extended opening width is formed at the rear end part of the side opening 12*g*, and at the part, engagement protrusions 12*h* that protrude toward the center of the opening from either opening side walls are formed as shown in FIG. 2(*e*).

Figure 3:
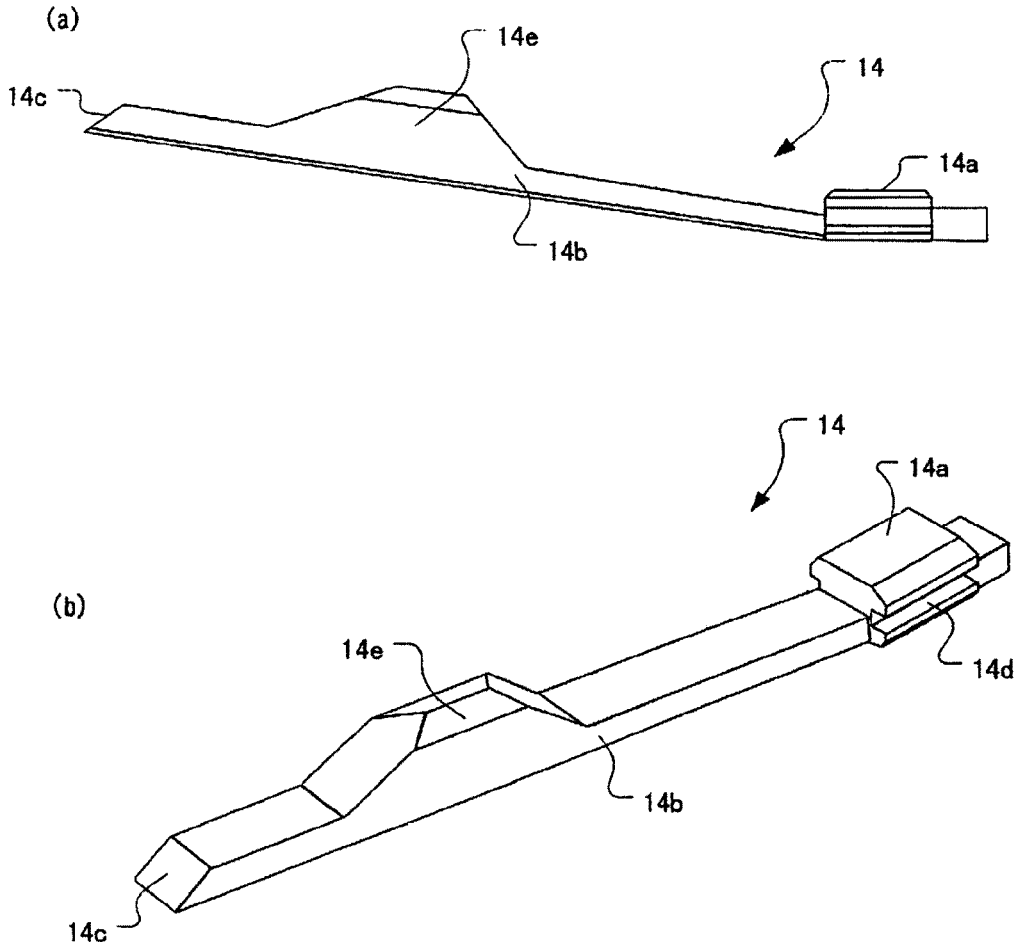
FIG. 3(*a*) is a side view of a swing cover of the lead cartridge of FIG. 1.

The swing cover 14 that can be configured as an integrated plastic molding includes a base 14*a*, a swing body 14*b*, and an interfered part 14*c* as shown in enlarged scale in FIG. 3.

In side surfaces of the base 14*a*, engagement grooves 14*d* that engage with the engagement protrusions 12*h* in the side opening 12*g* of the case 12 are formed. When the engagement grooves 14*d* engage with the engagement protrusions 12*h*, the base 14*a* can be mounted at the rear end part of the side opening 12*g*.

The swing body 14*b* is bent from the base 14*a* and biased into a bent state due to its own elasticity in a normal condition. However, the swing body 14*b* can be deformed to align with the base 14*a* against the elasticity. In the middle of the swing body 14*b* in an axial direction, a protrusion 14*e* is formed. The protrusion 14*e* has a protruding end in a tapering shape and is formed with a tapering surface inclined toward the tip end part as shown in FIG. 3(*b*).

The interfered part 14*c* is formed at the tip end of the swing body 14*b* and more specifically, is formed as a tapering surface that is thinner toward the tip end part of the swing body 14*b*.

At the rear end part of the case 12, the eraser advancing mechanism 16 is mounted as a stick article advancing mechanism. Instead of the eraser advancing mechanism 16, a simple stopper or a fixed eraser holder that is not advanced may be mounted at the rear end part of the case 12. However, if the eraser advancing mechanism 16 is mounted, erasers can be changed at the same time as refilling or changing leads. Further, if the eraser advancing mechanism 16 is mounted, an eraser can have a sufficient length in an axial direction, and thus the eraser can last a long time until finishing up leads in the lead cartridge 10.

Figure 4:
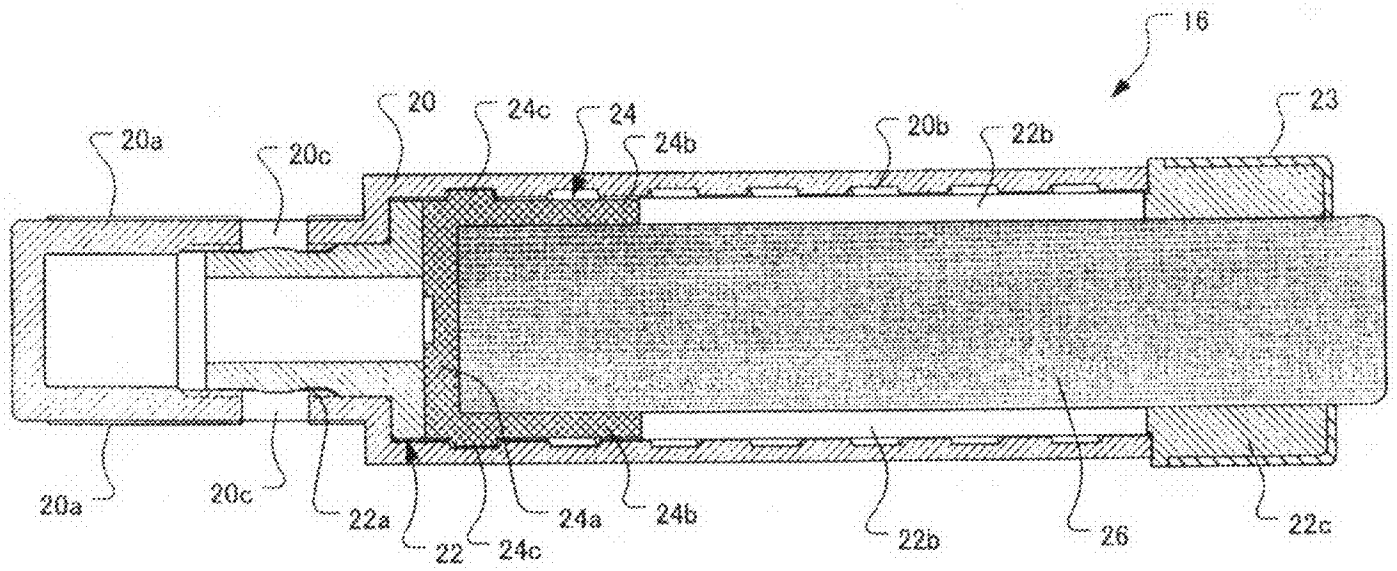
FIG. 4 is a longitudinal sectional view of an eraser advancing mechanism of the lead cartridge of FIG. 1.

Although the eraser advancing mechanism 16 can have an arbitrary configuration, the eraser advancing mechanism 16 in this embodiment includes a spiral sleeve 20, a guide sleeve 22, and an eraser holder 24 for holding an eraser 26 as shown in FIG. 4.

The spiral sleeve 20 is provided with engagement projections 20*a* that engage with a pair of engagement holes 12*j* formed in a rear part of the case 12. The engagement projections 20*a* engage with the engagement holes 12*j* and a rib 12*k* (see FIG. 2(*b*)) formed on the inner surface of the rear end part of the case 12 engages with a longitudinal groove (not shown) formed in the outer surface of the spiral sleeve 20, whereby the spiral sleeve 20 is connected to the case 12 non-rotatably with respect to the case 12 and immovably in an axial direction. A spiral groove 20*b* is formed in the inner surface of the spiral sleeve 20 and engagement holes 20*c* are formed in the outer surface thereof at a position anterior to a part where the spiral groove 20*b* is formed.

The guide sleeve 22 is inserted into the spiral sleeve 20 from the rear side thereof. At the tip end of the guide sleeve 22, an engagement sleeve 22*a* that engages with the engagement holes 20*c* is formed; in the middle of the guide sleeve 22, a pair of guide slits 22*b* extending in an axial direction is formed; and at the rear end part of the guide sleeve 22, an operating part 22*c* having an extended diameter is formed. Here, a decorative ring 23 may be appropriately mounted on the operating part 22*c*. The engagement sleeve 22*a* is formed to engage with the engagement holes 20*c* of the spiral sleeve 20 in a rotatable manner when the guide sleeve 22 is inserted into the spiral sleeve 20 from the rear side thereof.

When the operating part 22*c* and the engagement sleeve 22*a* of the guide sleeve 22 respectively engage with the spiral sleeve 20 in front and rear thereof, the guide sleeve 22 is arranged immovably in an axial direction and rotatably with respect to the spiral sleeve 20 on the inner surface side of the spiral sleeve 20.

The eraser holder 24 is arranged slidably in an axial direction with respect to the guide sleeve 22 and rotatably with respect to the spiral sleeve 20 in the guide sleeve 22. The eraser holder 24 includes a bottom part 24*a* for receiving a bottom face of the eraser 26 and a pair of holding sections 24*b* extending rearward from the bottom part 24*a* to hold the eraser 26. The holding sections 24*b* are fitted in the guide slits 22*b* of the guide sleeve 22 to be slidable in an axial direction in the guide slits 22*b*. An external thread 24*c* is formed on the outer surface of the holding sections 24*b* to be threaded with the spiral groove 20*b* of the spiral sleeve 20.

In the lead cartridge 10 configured as described above, the swing body 14*b* of the swing cover 14 bends from the base 14*a* toward the inside of the lead cartridge 10 when the lead cartridge 10 is stored alone by itself as shown in FIG. 1. Accordingly, the swing body 14 is positioned at the innermost of the notch 12*f* in a diameter direction to be in a closing position where specifically the protrusion 14*e* of the swing cover 14 closes the lead port 12*e*. Therefore, leads in the tank part 12*a* are prevented from passing through the lead port 12*e*.

Figure 5:
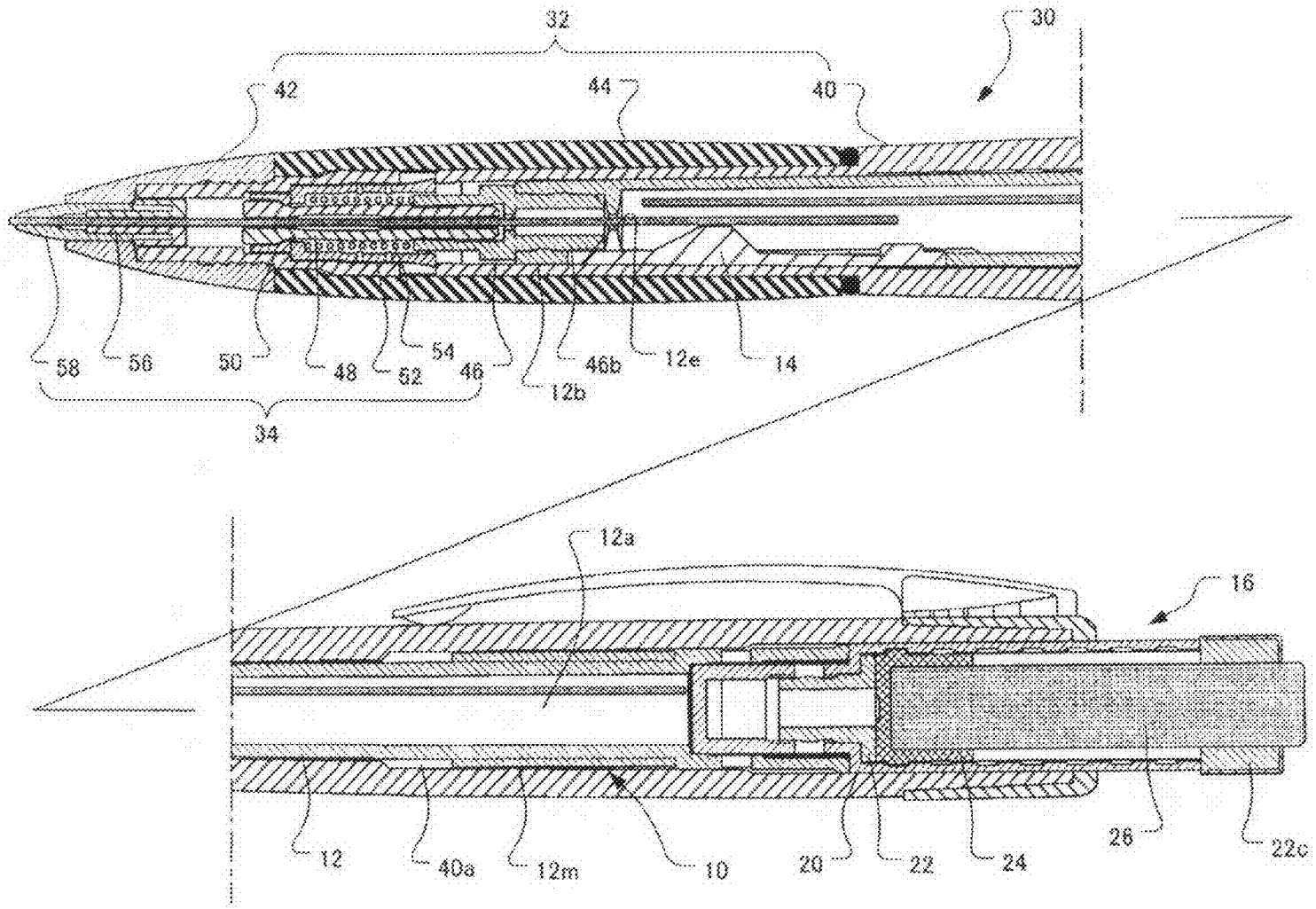
FIG. 5 is a longitudinal sectional view of the lead cartridge of FIG. 1 in a state loaded in a mechanical pencil.

FIG. 5 shows the lead cartridge 10 configured as described above in a state incorporated in a mechanical pencil 30. The mechanical pencil 30 includes an outer sleeve 32 and a lead feeding mechanism 34 mounted inside the outer sleeve 32.

The outer sleeve 32 includes a main body 40, a tip tool 42 to be threaded with the tip end of the main body 40, and a grip body 44 mounted on a grip part of the main body 40. On the inner surface of the main body 40, a rotation stop groove 40*a* is formed. When a rotation stop rib 12*m* of the case 12 of the lead cartridge 10 is engaged with the rotation stop groove 40*a*, the case 12 and the outer sleeve 32 are prevented from rotating with respect to each other.

The lead feeding mechanism 34 includes: a chuck joint 46; a lead chuck 48, the rear end of which is press-inserted into the chuck joint 46 to tighten a lead, and feed the lead; a chuck ring 50 fitted to the outer surface of the chuck part of the lead chuck 48 so as to be capable of tightening the chuck part; a sleeve 52 that limits a rearward movement of the chuck ring 50 and is engaged with the main body 40; a chuck spring 54 arranged between the sleeve 52 and the chuck joint 46 to bias the chuck joint 46 and the lead chuck 48 rearward; a slider 56 that is movable in the tip tool 42 and the tip end part of the main body 40; and a lead pipe 58, the rear end of which is connected to the slider 56.

Figure 6:
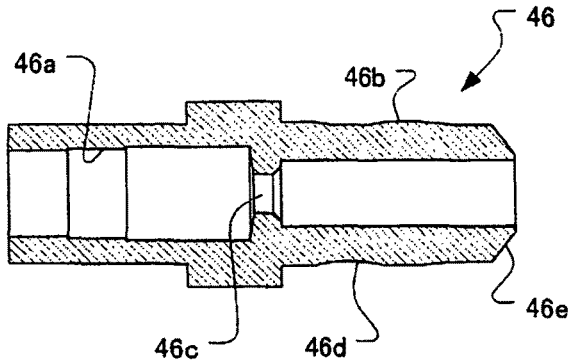
FIG. 6 is an enlarged sectional view of a chuck joint.

As shown in enlarged scale in FIG. 6, the chuck joint 46 includes a chuck press-insertion hole 46*a*, into which the rear end of the lead chuck 48 is press-inserted; a cartridge receiving part 46*b*, to which the tip end connection part 12*b* of the case 12 of the lead cartridge 10 is detachably connected; and a lead feeding hole 46*c*, through which leads pass one by one. On the outer surface of the cartridge receiving part 46*b*, a fitting recess part 46*d* that fits with the fitting rib 12*c* of the tip end connection part 12*b* of the case 12 is formed. The rear end surface of the cartridge receiving part 46*b* is formed as an interference part 46*e*. The interference part 46*e* is not perpendicular to an axial direction but has inclined tapering surfaces.

A connection between the lead cartridge 10 and the mechanical pencil 30 configured as described above is explained referring to FIG. 7.

The lead cartridge 10 is inserted to the mechanical pencil 30 from the rear side of the main body 40. When the tip end connection part 12*b* of the case 12 of the lead cartridge 10 reaches the cartridge receiving part 46*b* of the chuck joint 46, the cartridge receiving part 46*b* is inserted into the tip end connection part 12*b*.

Figure 7:
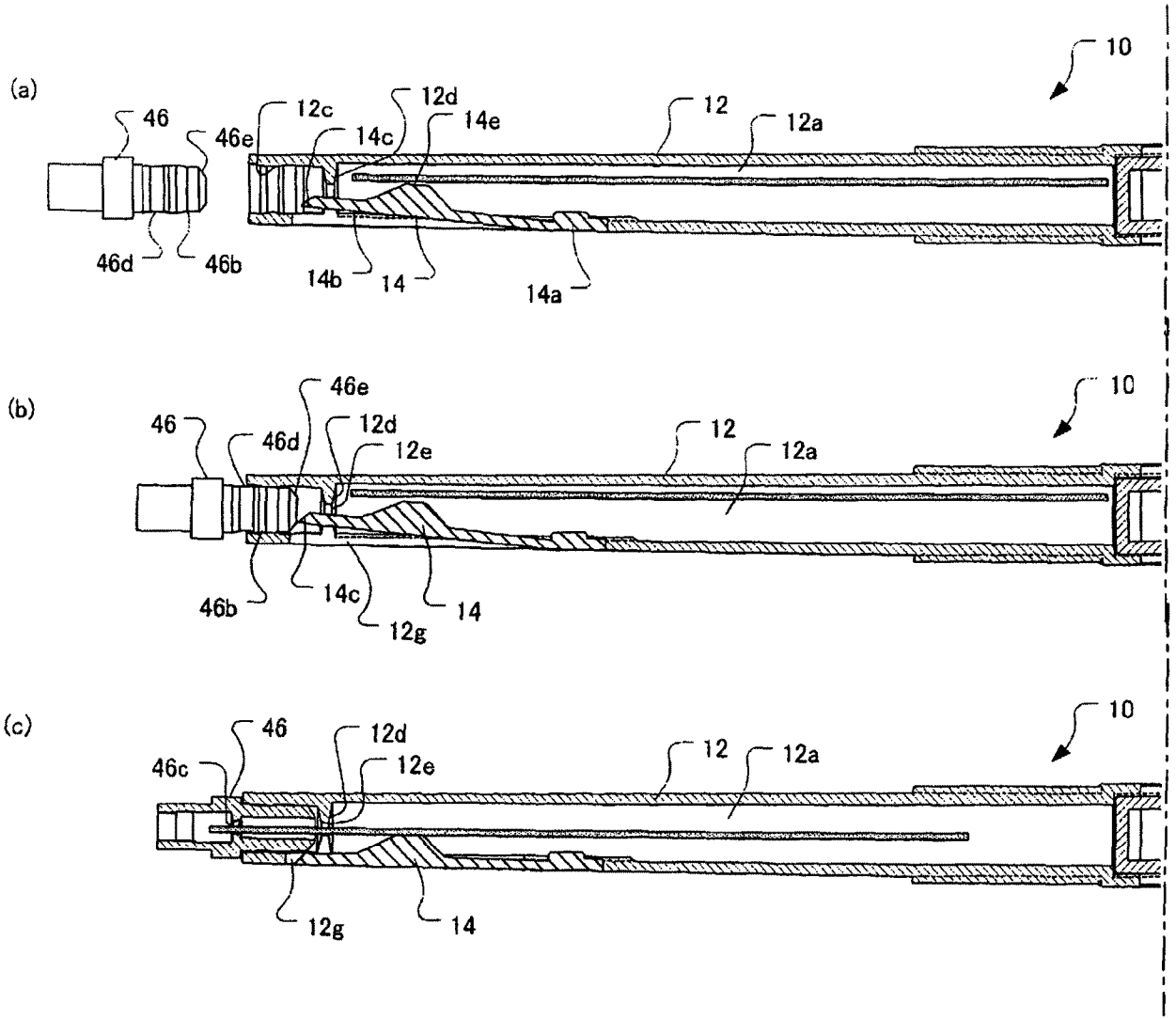
FIG. 7 is a view showing a relationship between the lead cartridge and a receiving part when the lead cartridge is being connected to the mechanical pencil.

At the same time, the tapering surface of the interfered part 14*c* at the tip end of the swing cover 14 slidably contacts with the tapering surface of the interference part 46*e* of the chuck joint 46, and the swing cover 14 swings when the cartridge receiving part 46*b* is inserted (FIG. 7(*b*)). When the cartridge receiving part 46*b* is entirely inserted into the tip end connection part 12*b* to fit the fitting rib 12*c* with the fitting recess part 46*d*, the swing cover 14 is deformed from the bent to align with the side hole 12*g* as shown in FIG. 7(*c*) so as to move to an opening position where the swing cover 14 opens the lead port 12*e*. Then the lead port 12*e* aligns with the lead feeding hole 46*c*. A lead can slide along the partition wall 12*d* in a funnel-shape from the tank part 12*a*, pass through the lead port 12*e* and the lead feeding hole 46*c*, and advance to the lead chuck 48. In this manner, it is possible to refill or change leads easily.

On the other hand, the lead cartridge 10 can be easily detached by pulling out the lead cartridge 10 from the outer sleeve 32. When the tip end connection part 12*b* of the lead cartridge 10 is separated away form the cartridge receiving part 46*b*, the swing cover 14 swings back by its elastic restoring force to move to the closing position where the swing cover 14 closes the lead port 12*e*. Therefore, even when some leads remain in the tank part 12*a*, the leads can be prevented from falling out from the lead cartridge 10.

When the lead cartridge 10 is incorporated in the mechanical pencil 30 as described above, the rear end part of the lead cartridge 10 including the operating part 22*c* of the guide sleeve 22 of the eraser advancing mechanism 16 protrudes out from the rear end of the outer sleeve 32. When the rear end part of the lead cartridge 10 is knocked forwardly, the chuck joint 46, lead chuck 48, and chuck ring 50 advance together with the lead cartridge 10 so as to send out a lead in a previously known manner to allow writing.

In addition, in order to use the eraser, the operating part 22*c* of the rear end part is operated to rotate while the outer sleeve 32 is fixed. Since the outer sleeve 32, case 12, and spiral sleeve 20 are prevented from rotating with respect to each other, the eraser holder 24 rotating integrally with the guide sleeve 22 rotates with respect to the case 12. Then the external thread 24*c* of the eraser holder 24 moves along the spiral groove 20*b* so as to advance the eraser 26. Further, when the operating part 22*c* is rotated in an opposite direction, the eraser 26 is retracted back into the spiral sleeve 20.

Since the opening/closing mechanism of the lead cartridge 10 is configured as the swing cover 14 as described above, the number of parts is reduced, and thus the number of steps for mounting the swing cover 14 to the case 12 can be reduced. Therefore, costs for manufacturing and the number of manufacturing steps can be reduced.

In addition, when the lead cartridge 10 exists by itself, the swing cover 14 closes the lead port 12*e* inside the lead cartridge 10 and it is difficult to easily operate the swing cover 14 from the outside. Therefore, the swing cover 14 may not be inadvertently operated so that leads are prevented from falling out from the tank part.

Further, since the swing cover 14 is arranged inside the lead cartridge 10, the whole length of the lead cartridge 10 can be short. Although the swing cover 14 has the protrusion 14*e* positioned inside the tank part 12*a* to close the lead port 12*e*, the protrusion 14*e* is in a tapering shape so as to make its volume occupying in the tank part 12*a* small. Therefore, a lead storage volume of the tank part 12*a* can be secured.

Here, an engagement force between engagement holes 12*j* of the case 12 and the engagement projection 20*a* of the spiral sleeve 20, the engagement force serving as a connecting force between the case 12 and the eraser advancing mechanism 16, needs to be larger than a connecting force between the lead cartridge 10 and the mechanical pencil 30 but is preferably small enough to allow a person to release the connection by hand. With such a configuration, it is possible to remove the eraser advancing mechanism 16 from the case 12 when the lead cartridge 10 exists by itself to allow for refilling with leads from the rear end of the case 12. For this purpose, it is preferable to provide short tapering parts on both side surfaces of the engagement projection 20*a* and/or the engagement holes 12*j* so as to allow for releasing the connection. Alternatively, it is possible to set a connection direction between the case 12 and the eraser advancing mechanism 16 and a connection direction between the lead cartridge 10 and the mechanical pencil 30 to be different instead of adjusting magnitude of the connecting force. For example, when the connection between the lead cartridge 10 and the mechanical pencil 30 is made/released by pushing/pulling in an axial direction, the connection between the case 12 and the eraser advancing mechanism 16 may be made/released through a rotating operation in clockwise/counterclockwise direction or in opposite directions.

Figure 8:
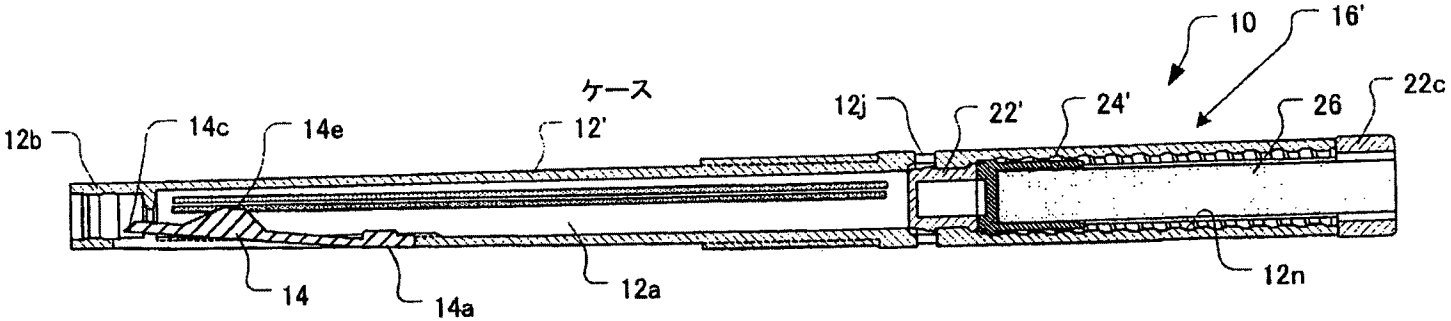
FIG. 8 is a whole longitudinal sectional view of a lead cartridge according to another embodiment of the invention.
Figure 9:
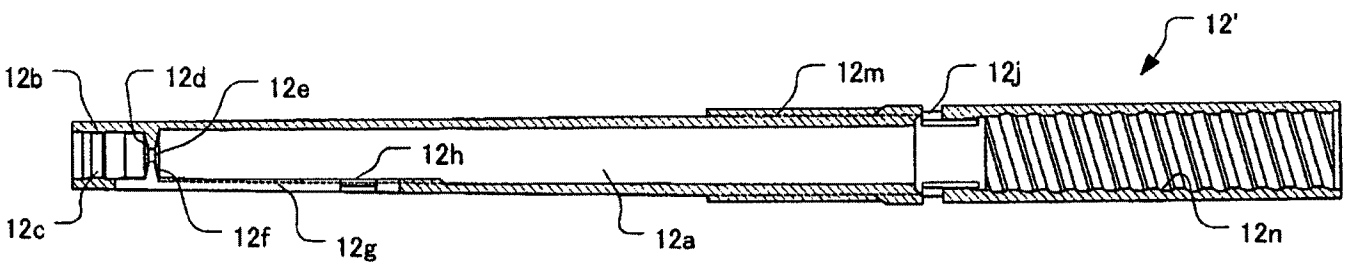
FIG. 9 is a longitudinal sectional view of a case of the lead cartridge of FIG. 8.

FIG. 8 is a longitudinal sectional view showing another embodiment of the lead cartridge 10. In this embodiment, a case 12' is a part of an eraser advancing mechanism 16' and the spiral sleeve is omitted. Specifically, the rear part of the case 12' is arranged to extend more rearwardly than the tank part 12*a* as shown in FIG. 9 and a spiral groove 12*n* is formed in the inner surface of the rear part. A guide sleeve 22' is rotatably engaged with the engagement holes 12*j* and the guide sleeve 22' is connected to the case 12' so as to be rotatable with respect to the case 12' and immovable in an axial direction. An eraser holder 24' is arranged in the guide sleeve 22' so as to be slidable in an axial direction with respect to the guide sleeve 22' and rotatable with respect to the case 12', and an external thread of the eraser holder 24' is threaded with the spiral groove 12*n* of the case 12'.

The eraser 26 can be advanced or retracted back into the case 12' through a rotating operation of the operating part 22*c* at the rear end part of the guide sleeve 22' that protrudes from the case 12'. With such configuration, the number of parts of the lead cartridge 10 can be reduced.

Although the interference part 46*e* is formed in the cartridge receiving part 46*b* in the embodiment described above, the configuration of the interference part 46*e* is not limited thereto and the interference part 46*e* may be formed in an arbitrary part of the mechanical pencil 30 other than the cartridge receiving part 46*b* as long as the part can contact with the interfered part 14*c*.

Figure 10:
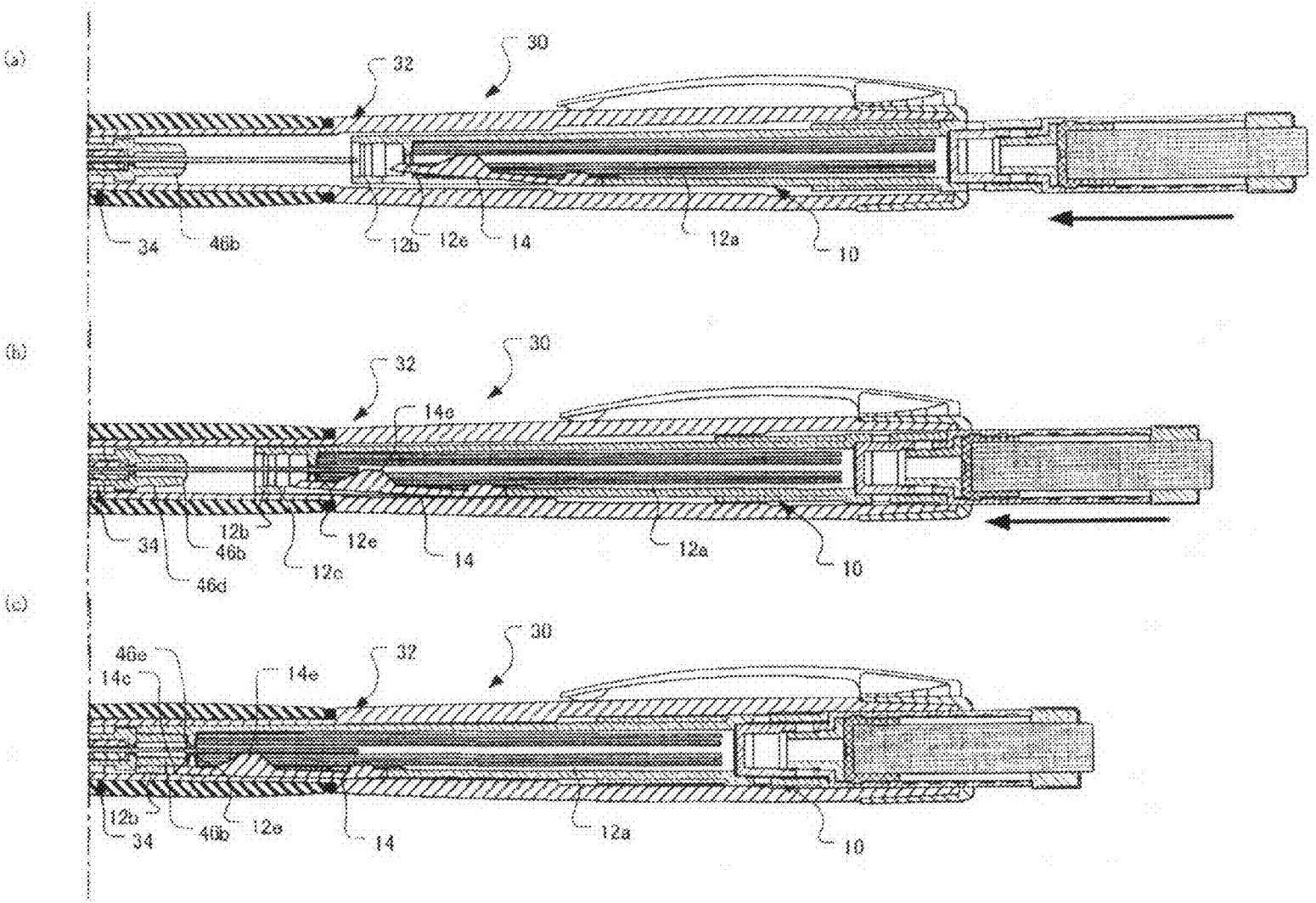
FIG. 10 is a view showing a relationship between the lead cartridge and a mechanical pencil when a lead held by a lead feeding mechanism remains in the mechanical pencil.

The lead cartridge 10 of the invention can be inserted into the mechanical pencil 30 even when a lead held by the lead feeding mechanism 34 remains in the mechanical pencil 30. The lead held by the lead feeding mechanism 34 in the mechanical pencil 30 can make the swing cover 14 swing and the lead port 12*e* provides an opening allowing the lead to be inserted therethrough. FIG. 10 is a view showing the mechanical pencil 30 when the lead cartridge is inserted with a lead remaining in the mechanical pencil 30.

When the lead cartridge 10 reaches the rear end of the lead remaining in the mechanical pencil 30 (FIG. 10(*a*)), the rear end of the lead passes through the lead port 12*e* and contacts the protrusion 14*e* so as to make the swing cover 14 swing (FIG. 10(*b*)). Then the lead can advance into the tank part 12*a* of the lead cartridge. At this time, since leads that are originally stored in the tank part 12*a* of the lead cartridge 10 have been arranged around the swing cover 14, the leads do not interfere with the lead being inserted, and thus the leads can be prevented from being broken.

After that, when the tip end connection part 12*b* of the case 12 of the lead cartridge 10 reaches the cartridge receiving part 46*b* of the chuck joint 46, the cartridge receiving part 46*b* is inserted into the tip end connection part 12*b*, so that the fitting rib 12*c* is fitted with the fitting recess part 46*d* (FIG. 10(*c*)). When the tapering surface of the interfered part 14*c* at the tip end of the swing cover 14 slidably concats with the tapering surface of the interference part 46*e* of the chuck joint 46, the swing cover 14 completely opens the lead port.

Since the swing cover 14 of the lead cartridge 10 swings even when a lead remains in the mechanical pencil 30 as described above, it is possible to finish up the lead and to continuously use a lead supplied from the cartridge 10.

Since the swing cover 14 substantially closes the lead port 12*e* at a position posterior to the lead port 12*e* but does not directly choke the lead port 12*e*, a lead remaining in the mechanical pencil 30 can pass through the lead port 12*e*. In addition, because of the existence of, protrusion 14*e* of the swing cover 14, no lead is present at the rear of the protrusion 14*e*, so that no lead aligns with the lead port 12*e*. Therefore, a lead remaining in the mechanical pencil 30 and a lead stored in the tank part 12*a* of the lead cartridge 10 can be prevented from aligning with each other. If they aligned with each other, a lead in the tank part 12*a* would be pushed rearwardly so as to hit the eraser advancing mechanism 16 provided at the rear end of the tank part 12*a*, then the lead might be broken. Such situation can be prevented in this embodiment.

The invention claimed is:

1. A lead cartridge adapted for storing leads and capable of being detachably connected to a lead feeding mechanism of a mechanical pencil to supply the leads one by one to the lead feeding mechanism, the mechanical pencil being provided with an interference part, the lead feeding mechanism a receiving part, the lead cartridge comprising:

a tank part for storing the leads therein;

a tip end connection part capable of being detachably fitted with the receiving part of the lead feeding mechanism;

a lead port provided on a tip end side of the tank part to allow one of the leads in the tank part to pass therethrough from the tank part; and a swing cover arranged in the lead cartridge so as to be swingable between a closing position where the swing cover closes the lead port, and an opening position where the swing cover opens the lead port;

wherein the swing cover is biased in a swing direction from the opening position to the closing position but is adapted to be swung from the closing position to the opening position by the interference part when the tip end connection part is fitted with the receiving part, and wherein, when the tip end connection part is fitted with the receiving part in a state where the lead feeding mechanism holds a lead, the swing cover is adapted to be swingable from the closing position to the opening position by the lead held by the lead feeding mechanism, in addition to thekin place by the interference part.

2. The lead cartridge according to claim 1, further comprising a case, wherein the tank part is formed inside the case, the tip end connection part is formed at a tip end part of the case, the lead port is formed between the tank part and the tip end connection part in the case, and the swing cover is mounted in a side opening formed in a side part of the case.

3. The lead cartridge according to claim 1, wherein an interfered part is formed with a tapering surface formed at a tip end of the swing cover.

4. The lead cartridge according to claim 1, wherein at least a part of the swing cover is arranged in the tank part.

5. The lead cartridge according to claim 4, wherein a protrusion that closes the lead port is formed on the swing cover and a protruding end of the protrusion is in a tapering shape.

6. The lead cartridge according to claim 1, further comprising a stick article advancing mechanism that advances a stick article through a rotating operation at a rear part of the lead cartridge.

7. A mechanical pencil comprising the lead cartridge according to claim 1 loaded therein.

8. A lead cartridge adapted for storing leads and capable of being detachably connected to a lead feeding mechanism of a mechanical pencil to supply the leads one by one to the lead feeding mechanism, the lead feeding mechanism being provided with a receiving part, the lead cartridge comprising:

a tank part for storing the leads therein;

a tip end connection part capable of being detachably fitted with the receiving part of the lead feeding mechanism;

a lead port provided on a tip end side of the tank part to allow one of the leads in the tank part to pass therethrough from the tank part; and a swing cover arranged in the lead cartridge so as to be swingable to a closing position where the swing cover closes the lead port and to an opening position where the swing cover opens the lead port at a position posterior to the lead port, wherein the swing cover is biased in a swing direction from the opening position to the closing position, adapted to be swung from the closing position to the opening position when the tip end connection part is fitted with the receiving part, and adapted to prevent a lead in the tank part from aligning with the lead port in a condition closing the lead port, so that when the tip end connection part is fitted with the receiving part in a state where the lead feeding mechanism holds a lead, the lead held by the lead feeding mechanism and a lead in the tank part can be prevented from aligning with each other.

9. The lead cartridge according to claim 2, wherein the interfered part is formed with a tapering surface formed at a tip end of the swing cover.

10. The lead cartridge according to claim 2, wherein at least a part of the swing cover is arranged in the tank part.

11. The lead cartridge according to claim 3, wherein at least a part of the swing cover is arranged in the tank part.

12. The lead cartridge according to claim 2, further comprising a stick article advancing mechanism that advances a stick article through a rotating operation at a rear part of the lead cartridge.

13. The lead cartridge according to claim 3, further comprising a stick article advancing mechanism that advances a stick article through a rotating operation at a rear part of the lead cartridge.

14. The lead cartridge according to claim 4, further comprising a stick article advancing mechanism that advances a stick article through a rotating operation at a rear part of the lead cartridge.

15. The lead cartridge according to claim 5, further comprising a stick article advancing mechanism that advances a stick article through a rotating operation at a rear part of the lead cartridge.

16. The lead cartridge according to claim 8, wherein, when the tip end connection part is fitted with the receiving part in the state where the lead feeding mechanism holds the lead, the swing cover is adapted to be swingable from the closing position to the opening position by the lead held by the lead feeding mechanism.

17. A mechanical pencil comprising the lead cartridge according to claim 8 loaded therein.

18. A lead cartridge adapted for storing leads and capable of being detachably connected to a lead feeding mechanism of a mechanical pencil to supply the leads one by one to the lead feeding mechanism, the mechanical pencil being provided with an interference part, the lead feeding mechanism being provided with a receiving part, the lead cartridge comprising:

a tank part for storing the leads therein;

a tip end connection part capable of being detachably fitted with the receiving part of the lead feeding mechanism;

a lead port provided on a tip end side of the tank part to allow one of the leads in the tank part to pass therethrough from the tank part; and a swing cover arranged in the lead cartridge so as to be swingable between a closing position where the swing cover closes the lead port, and an opening position where the swing cover opens the lead port at a position posterior to the lead port, the swing cover including an interfered part capable of being interfered with the interference part of the mechanical pencil, wherein the swing cover is biased in a swing direction from the opening position to the closing position, wherein the swing cover is adapted to be swung from the closing position to the opening position when the tip end connection part is fitted with the receiving part so as to cause the interfered part to be interfered with the interference part, wherein the swing cover is adapted to prevent a lead in the tank part from aligning with the lead port in a condition closing the lead port, such that when the tip end connection part is fitted with the receiving part in a state where the lead feeding mechanism holds a lead, the lead held by the lead feeding mechanism and a lead in the tank part can be prevented from aligning with each other, and wherein, when the tip end connection part is fitted with the receiving part in the state where the lead feeding mechanism holds the lead, the swing cover is adapted to be swingable from the closing position to the opening position by the lead held by the lead feeding mechanism, in addition to the swinging movement taking place by the fitting of the tip end connection part with the receiving part.

19. A mechanical pencil comprising the lead cartridge according to claim 18 loaded therein.

* * * * *